US006198895B1

(12) United States Patent
Tsuda et al.

(10) Patent No.: US 6,198,895 B1
(45) Date of Patent: Mar. 6, 2001

(54) DEVELOPING DEVICE WITH IMPROVED DEVELOPER CIRCULATION AND TONER DENSITY CONTROL

(75) Inventors: Kiyonori Tsuda, Machida; Tsuyoshi Imamura; Shunji Katoh, both of Sagamihara; Hideo Yoshizawa, Urawa; Shinji Tamaki, Arakawa-ku; Masayuki Yamane, Yokohana, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/500,167

(22) Filed: Feb. 8, 2000

(30) Foreign Application Priority Data

Feb. 8, 1999 (JP) ..... 11-030404
Feb. 9, 1999 (JP) ..... 11-031705

(51) Int. Cl.[7] ..... G03G 15/08
(52) U.S. Cl. ..... 399/267; 399/274; 399/284
(58) Field of Search ..... 399/267, 274, 399/284

(56) References Cited

U.S. PATENT DOCUMENTS

| | | | | |
|---|---|---|---|---|
| 4,800,411 | * | 1/1989 | Tanaka et al. | 399/267 |
| 4,987,449 | | 1/1991 | Kataoh . | |
| 5,227,847 | | 7/1993 | Motohashi et al. . | |
| 5,244,741 | | 9/1993 | Nagano et al. . | |
| 5,659,860 | | 8/1997 | Sasaki et al. . | |
| 5,765,079 | | 6/1998 | Yoshiki et al. . | |
| 5,771,426 | | 6/1998 | Oka et al. . | |
| 5,794,108 | | 8/1998 | Yoshizawa et al. . | |
| 5,805,965 | | 9/1998 | Tsuda et al. . | |
| 5,822,664 | | 10/1998 | Oka et al. . | |
| 5,909,609 | | 6/1999 | Yahata et al. . | |
| 5,915,155 | | 6/1999 | Shoji et al. . | |
| 5,970,290 | | 10/1999 | Yoshiki et al. . | |
| 5,970,294 | | 10/1999 | Narita et al. . | |

FOREIGN PATENT DOCUMENTS

| | | |
|---|---|---|
| 63-4280 | 1/1988 | (JP) . |
| 5-6102 | 1/1993 | (JP) . |
| 5-249821 | 9/1993 | (JP) . |
| 9-22178 | 1/1997 | (JP) . |
| 9-197833 | 7/1997 | (JP) . |
| 9-329954 | 12/1997 | (JP) . |
| 11-2958 | 1/1999 | (JP) . |
| 11-194617 | 7/1999 | (JP) . |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A developing device for an image forming apparatus includes a developer carrier such as a developing sleeve having a magnetic field generating device therein which carries and conveys a developer containing toner and magnetic carrier particles. The developing device also includes a first regulating member such as a blade which regulates the developer being carried and conveyed by the developer carrier, and a developer storing section stores developer scraped off the developer carrier by the first regulating member. The developer storing section includes a second regulating member arranged upstream of the first regulating member with respect to a direction in which the developer carrier conveys the developer. The developing device further includes a toner storing section provided adjacent to the developer storing section to supply toner to the developer carrier. A contact condition of the developer carried on the developer carrier with the toner supplied to the developer carrier from the toner storing section is varied in accordance with variation of a toner density in the developer carried on the developer carrier to thereby vary a condition of the developer on the developer carrier to attract the toner. The second regulating member is spaced from the developer carrier such that when a thickness of a layer of the developer on the developer carrier increases due to an increase of the toner density in the developer on the developer carrier, the second regulating member regulates an increased amount of the developer being carried and conveyed by the developer carrier. The magnetic fields, toner speeds, and distances of the regulating members to the developer carrier satisfy predetermined conditions in different embodiments.

29 Claims, 6 Drawing Sheets

$\alpha > \beta > \gamma$ $\gamma \fallingdotseq 0$ mm/sec

DEVELOPING DEVICE WITH IMPROVED DEVELOPER CIRCULATION AND TONER DENSITY CONTROL

BACKGROUND OF THE INVENTION

1. Field of the Invention

The present invention relates to a developing device for use in an image forming apparatus such as a copying machine, a facsimile, a printer, or other similar image forming apparatuses, and more particularly to a developing device that develops a latent image formed on an image bearing member with a two-component developer, i.e., a mixture of toner and magnetic carrier particles.

2. Discussion of the Background

In a background developing device that develops a latent image formed on an image bearing member with a two-component developer containing a mixture of toner and magnetic carrier particles, it is known that a toner density in the two-component developer is controlled by the movement of the developer without using a toner density detecting device.

For example, Japanese Laid-open Patent Publication No. 63-4280 describes a developing device which includes; a developer container with an opening for containing a developer containing a mixture of toner and magnetic carrier particles; a developer carrying member having a magnetic field generating device therein, disposed in the opening of the developer container, for carrying the developer out of the developer container to a developing position where a latent image is developed with the developer; a developer regulating device spaced apart from a surface of the developer carrying member for regulating a thickness of a developer layer; and a developer movement limiting member which is mounted to an inside surface of the developer regulating device and limits the moving region of the developer in the developer container. In addition, a developer layer formed adjacent the surface of the developer carrying member is formed into a movable layer which moves following the movement of the surface of the developer carrying member and into a stationary layer which is formed outside of the movable layer and substantially unmovable by being stopped by the limiting member. Outside the stationary layer, there is formed a toner layer containing substantially only toner particles. The stationary layer deforms along a magnetic line of force that is produced by the magnetic field generating device.

The above-described background developing device controls the toner density in the developer on the basis of the movement of the developer itself and eliminates the need for a toner density control mechanism including a developer agitating and conveying member. This successfully reduces the size and cost of the developing device.

In the developing device with the above-described configuration, the movement of the developer effecting the supply of toner depends on an amount of toner on the surfaces of the developer, that is a toner covering ratio of the developer. Specifically, when the toner covering ratio of the developer at a position upstream of the developer regulating member in a developer conveying direction is low, the developer is quickly circulated and a supply of toner is enhanced. As the toner covering ratio of the developer is higher, the developer is circulated slowly. When the toner covering ratio is approximately 100%, the supply of toner is stopped. A condition in which toner particles fully cover the surface of a single carrier particle in a single layer without any clearance represents a 100% toner covering ratio.

In the above-described developing device, an exposed area of the developer which contacts the toner supplied from the developer container is relatively large, and the amount of supply of toner depends on how the developer is carried by the developer carrying member. Specifically, when the developer is unevenly deposited on the surface of the developer carrying member, the toner is irregularly supplied to the developer on the developer carrying member. For example, at a place where much developer is carried on the surface of the developer carrying member, the toner is not positively supplied to the developer. On the other hand, the toner is positively supplied to the developer at a place where little developer is carried on the surface of the developer carrying member. As a result, an irregular toner density occurs on an image. Further, in the developer conveying direction of the developer carrying member, the toner is not supplied to a place apart from the surface of the developer carrying member where the developer moving speed is about 0 mm/sec. On the other hand, the toner is supplied to a place near the surface of the developer carrying member where the developer moving speed is higher. In the above-described condition, the supply of toner is not precisely controlled, so that the toner density is not accurately controlled.

The irregular toner density causes a background fouling when the toner density is high, and a lower image density or carrier adhesion to the image when the toner density is low.

Another background developing device includes a developer carrier having a magnetic field generating device therein, configured to carry and convey a developer containing toner and magnetic carrier particles; a first regulating member configured to regulate the developer being carried and conveyed by the developer carrier; a developer storing section configured to store developer scraped off the developer carrier by the first regulating member; and a toner storing section provided adjacent to the developer storing section to supply toner to the developer carrier. Further, the developer storing section includes a second regulating member arranged upstream of the first regulating member with respect to a direction in which the developer carrier conveys the developer. The second regulating member is spaced from the developer carrier such that when a thickness of a layer of the developer on the developer carrier increases due to an increase of the toner density in the developer on the developer carrier, and regulates an increased amount of the developer being carried and conveyed by the developer carrier. A contact condition of the developer carried on the developer carrier with the toner supplied to the developer carrier from the toner storing section is varied in accordance with variation of a toner density in the developer carried on the developer carrier to thereby vary a condition of the developer on the developer carrier to attract the toner.

In the above-described background developing device, the toner and magnetic carrier particles are agitated by circulation of the developer in the developer storing section. This successfully avoids the charging amount of toner from lowering, and reduces the occurrence of deterioration of image quality, such as, an irregular image density and a fog of an image. In the developing device with the above-described configuration, in order to further reduce the occurrence of an irregular image density and a fog of an image, active circulation of the developer in the developer storing section is desired.

SUMMARY OF THE INVENTION

The present invention has been made in view of the above-discussed and other problems, and an object of the present invention is to address these problems.

The preferred embodiment of the present invention provides a novel developing device that controls a supply of toner to a developer to form a good quality image free from irregular image density.

The preferred embodiment of the present invention provides a novel developing device that controls image density by circulation of a developer in a developer storing section to obtain a good quality image free from irregular image density.

In order to achieve the above and other objectives, the present invention provides a novel developing device including a developer carrier having a magnetic field generating device therein, configured to carry and convey a developer containing toner and magnetic carrier particles, a first regulating member configured to regulate the developer being carried and conveyed by the developer carrier, and a developer storing section configured to store developer scraped off the developer carrier by the first regulating member. The developer storing section includes a second regulating member arranged upstream of the first regulating member with respect to a direction in which the developer carrier conveys the developer. The developing device further includes a toner storing section provided adjacent to the developer storing section to supply toner to the developer carrier. A contact condition of the developer carried on the developer carrier with the toner supplied to the developer carrier from the toner storing section is varied in accordance with variation of a toner density in the developer carried on the developer carrier to thereby vary a condition of the developer on the developer carrier to attract the toner. The second regulating member is spaced from the developer carrier such that when a thickness of a layer of the developer on the developer carrier increases due to an increase of the toner density in the developer on the developer carrier, the second regulating member regulates an increased amount of the developer being carried and conveyed by the developer carrier. A magnetic force exerted on the developer on the developer carrier satisfies the following condition:

$$\mu X\ Fr1+Ft1<\mu X\ Fr2+Ft2 \quad (1')$$

where $\mu$ is a coefficient of fiction between the developer and a surface of the developer carrier, Fr1 is a radial direction component of the magnetic force at a position of the developer carrier facing the first regulating member, Ft1 is a tangential direction component of the magnetic force at the position of the developer carrier facing the first regulating member, Fr2 is a radial direction component of the magnetic force at a position of the developer carrier facing the second regulating member, and Ft2 is a tangential direction component of the magnetic force at the position of the developer carrier facing the second regulating member, and where a direction in which the developer is attracted to the developer carrier is defined as a positive direction in the radial direction component of the magnetic force, and a developer conveying direction is defined as a positive direction in the tangential direction component of the magnetic force.

According to the present invention, an angle between magnetic fields acting on the developer on the developer carrier in a radial direction of the developer carrier and in a tangential direction of the developer carrier may satisfy the following condition:

$$\tan^{-1}|Hr1/Ht1|>\tan^{-1}|H2/Ht2| \quad (2')$$

where Hr1 is a magnetic field in the radial direction of the developer carrier at the position of the developer carrier facing the first regulating member, Ht1 is a magnetic field in the tangential direction of the developer carrier at the position of the developer carrier facing the first regulating member, Hr2 is a magnetic field in the radial direction of the developer carrier at the position of the developer carrier facing the second regulating member, and Ht2 is a magnetic field in the tangential direction of the developer carrier at the position of the developer carrier facing the second regulating member.

A radial direction magnetic force exerted on the developer by the magnetic field generating device of the developer carrier may satisfy the following condition:

$$F'r1<F'r2 \quad (3')$$

where F'r1 is a radial direction magnetic force exerted on the developer by the magnetic field generating device at a position of the developer carrier facing the first regulating member, and F'r2 is a radial direction magnetic force exerted on the developer by the magnetic field generating device at a position of the developer carrier facing the second regulating member.

The above-described condition (2') may be satisfied by a magnetic force of the magnetic field generating device of the developer carrier.

According to another preferred embodiment of the present invention, the second regulating member facing the surface of the developer carrier is spaced a predetermined distance apart from the surface of the developer carrier such that when a toner covering ratio of a carrier particle in the developer stored in the developer storing section is in a range of about 80% to about 100%, the second regulating member regulates the toner supplied onto the developer carrier so as not to be supplied to the developer in the developer storing section.

The second regulating member may be spaced the predetermined distance apart from the surface of the developer carrier such that when a toner covering ratio of a carrier particle in the developer stored in the developer storing section is in a range of about 80% to about 100%, the second regulating member regulates the developer being carried and conveyed by the developer carrier at a position where the developer moves at a speed of about 0 mm/sec. to about 10 mm/sec.

The second regulating member may regulate the developer being carried and conveyed by the developer carrier at a position in a developer conveying direction where a magnetic flux density in a direction normal to the surface of the developer carrier is about 5 mT or less.

The second regulating member may be spaced about 0.5 mm to about 2.0 mm apart from the surface of the developer carrier.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
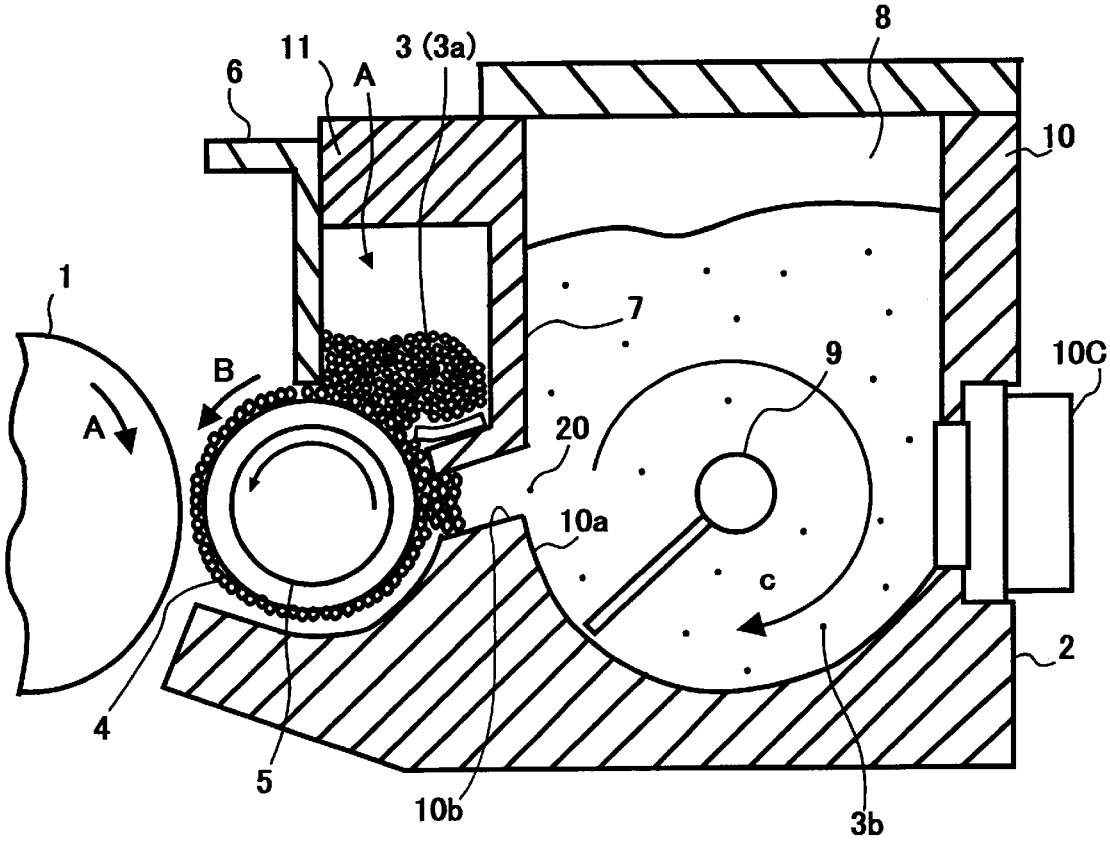
FIG. 1 is a schematic view illustrating a main construction of a developing device according to an embodiment of the present invention.

Referring now to the drawings, wherein like reference numerals designate identical or corresponding parts throughout the several views, embodiments of the present invention employed in a developing device of an image forming apparatus, such as a copying machine, a facsimile, a printer, or other similar image forming apparatuses, are now described.

FIG. 1 is a schematic view illustrating a main construction of a developing device according to an embodiment of the present invention.

Referring to FIG. 1, a developing device 2 is positioned at one side of a photoconductive drum 1 as a latent image carrier and includes a casing 10, a developing sleeve 4 as a developer carrier, a developer storing member 11, and a first doctor blade 6 as a first developer regulating member. The casing 10 having an opening which is directed towards the photoconductive drum 1 forms a toner hopper 8 as a toner storing section which stores toner 3*b*. The developer storing member 11 is integrally formed with the casing 10 at the side of the toner hopper 8 near the photoconductive drum 1 and forms a developer storing section A to store developer 3, i.e., a mixture of magnetic carrier particles 3*a* and the toner 3*b* therein. For example, the magnetic carrier particles 3*a* have a low resistance and a size of about 20 $\mu$m to about 50 $\mu$m. A projection 10*a* having a surface 10*b* protrudes from the portion of the casing 10 below the developer storing member 11. A toner supply opening 20 is formed between the surface 10*b* and the lower end of the developer storing member 11 to supply the toner 3*b* to the developer 3 carried by the developing sleeve 4.

In the toner hopper 8, an agitator 9 serving as a toner supply device is disposed and rotated by a driving device (not shown). The agitator 9 feeds the toner 3*b* in the toner hopper 8 toward the toner supply opening 20 while agitating the toner 3*b*. On the wall of the toner hopper 8 facing the photoconductive drum 1 with the intermediary of the developing sleeve 4, a toner end detecting device 10*c* is provided to detect a condition in which the amount of the toner 3*b* in the toner hopper 8 is low.

The developing sleeve 4 is provided between the photoconductive drum 1 and the toner hopper 8, and is driven to rotate by a driving device (not shown) in the direction indicated by an arrow B in FIG. 1. The developing sleeve 4 includes a rotatable magnetic roller 5 serving as a magnet field generating device that is fixed in position relative to the developing device 2.

The first doctor blade 6 is integrally mounted on the side of the developer storing member 11 opposite to the side mounted on the casing 10. The first doctor blade 6 is arranged such that a predetermined gap is formed between the edge of the first doctor blade 6 and the periphery of the developing sleeve 4. The first doctor blade 6 regulates the developer 3 passing through the above-described gap between the edge of the first doctor blade 6 and the periphery of the developing sleeve 4. The position where the first doctor blade 6 regulates the developer 3 is hereinafter referred to as a first doctor blade regulating position G1.

A second doctor blade 7 as a second developer regulating member has an end mounted to the developer storing member 11 in the vicinity of the toner supply opening 20. The second doctor blade 7 extends out from the developer storing member 11 toward the center of the developing sleeve 4, i.e., in the direction in which its other end obstructs the flow of the developer 3. A predetermined gap is formed between the edge of the second doctor blade 7 and the periphery of the developing sleeve 4. The second doctor blade 7 regulates the developer 3 passing through the above-described gap between the edge of the second doctor blade 7 and the periphery of the developing sleeve 4. The position where the second doctor blade 7 regulates the developer 3 is hereinafter referred to as a second doctor blade regulating position G2.

A space of the developer storing section A is so sized as to allow the developer 3 to be circulated over the range in which the magnetic force of the magnetic roller 5 in the developing sleeve 4 acts.

The surface 10*b* of the projection 10*a* extends over a predetermined length and is inclined downward from the toner hopper 8 side toward the developing sleeve 4 side. Even if the carrier particles 3*b* in the developer storing section A drop via the gap between the edge of the second doctor blade 7 and the periphery of the developing sleeve 4 due to vibration, irregular magnetic force distribution of the magnetic roller 5 provided in the developing sleeve 4, or local increases in the toner density of the developer 3, the carrier particles 3 a are received by the surface 10*b* and moved toward the developing sleeve 4 along the surface 10*b*. As a result, the carrier particles 3*a* are magnetically carried by the developing sleeve 4 and conveyed to the developer storing section A. The above-described configuration avoids a decrease of the amount of carrier particles 3*a* in the developer storing section A, and thereby frees an image from irregular density in the axial direction of the developing sleeve 4.

The toner 3*b* fed out from the toner hopper 8 by the agitator 9 is supplied to the developer 3 carried and conveyed by the developing sleeve 4 via the toner supply opening 20. The developing sleeve 4 carries and conveys the developer 3 with the supplied toner 3*b* to the developer storing section A. The developer 3 in the developer storing section A is carried and conveyed by the developing sleeve 4 to a developing position where the developing sleeve 4 faces the photoconductive drum 1. At the developing position, only the toner 3*b* is transferred from the developing sleeve 4 to the photoconductive drum 1 to develop a latent image formed on the photoconductive drum 1.

Figure 2A:
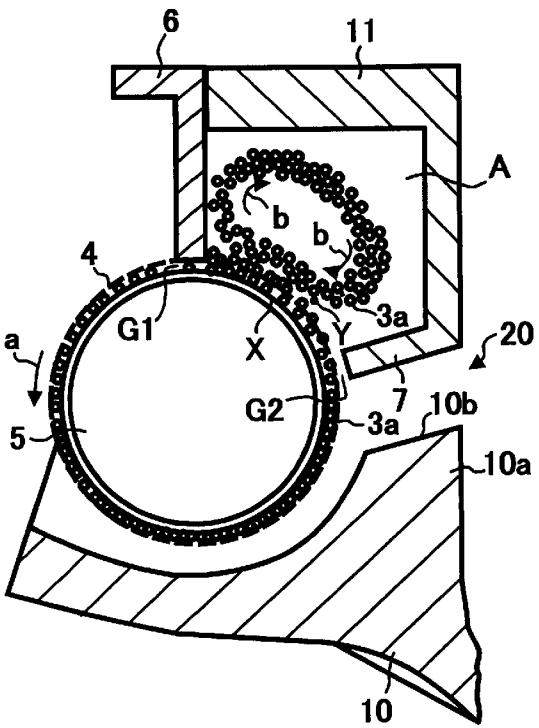
FIGS. 2A through 2C are explanatory views of a behavior of a behavior of developer in a developing device according to a first embodiment of the present invention.
Figure 2B:
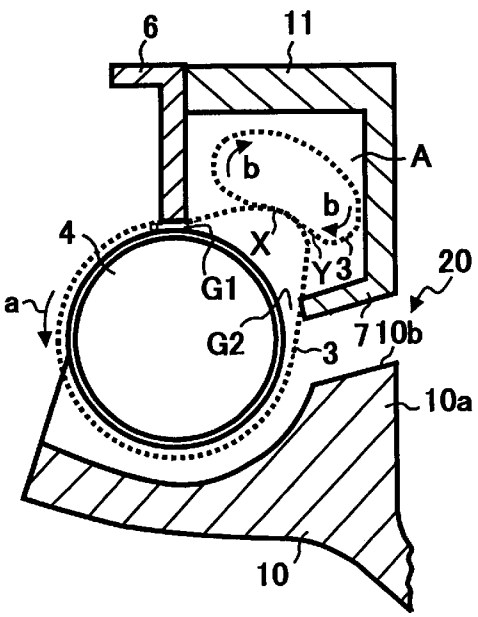
Figure 2C:
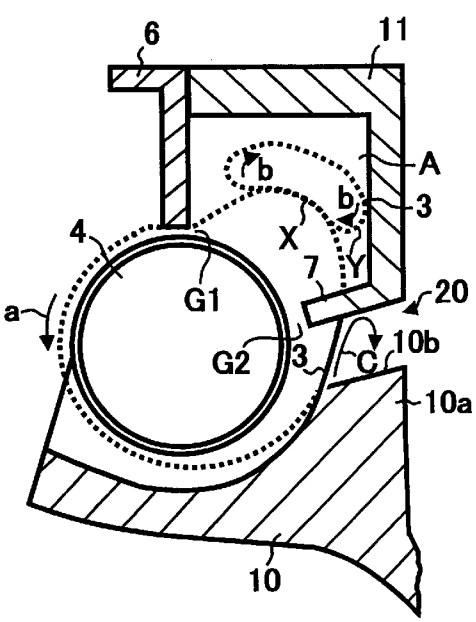

Next, a behavior of the developer 3 during toner image formation is described referring to FIGS. 2A through 2C. As illustrated in FIG. 2A, when a starting agent consisting only of magnetic carrier particles 3*a* is set in the developing device 2, the carrier particles 3*a* are partly magnetically deposited on the developing sleeve 4 and partly received in the developer storing section A. The carrier particles 3*a* received in the developer storing section A are circulated in the direction indicated by an arrow b (hereinafter referred to as the direction b) at a speed of 1 mm/sec. or higher, due to the magnetic force acting from the magnetic roller 5 and by the rotation of the developing sleeve 4 in the direction indicated by an arrow a. An interface X is formed between the surface of the carrier particles 3*a* carried by the developing sleeve 4 and the surface of the carrier particles 3*a* moving in the developer storing section A.

Subsequently, when the toner 3*b* is set in the toner hopper 8, the toner 3*b* is supplied to the carrier particles 3*a* carried and conveyed by the developing sleeve 4 via the toner supply opening 20. As a result, the developing sleeve 4 carries the developer 3 that is the mixture of the carrier particles 3*a* and the toner 3*b*.

The developer 3 in the developer storing section A exerts a force tending to stop the developer 3 from being conveyed by the developing sleeve 4. When the toner 3*b* existing on the surface of the developer 3 carried by the developing sleeve 4 is brought to the interface X, friction acting between the two parts of the developer 3 around the interface X decreases, and in turn the developer conveying force around the interface X decreases. As a result, the amount of the developer 3 being conveyed decreases around the interface X.

The two parts of the developer 3 join each other at a point Y. The above-described force tending to stop the developer 3 carried and conveyed by the developing sleeve 4 does not act on the developer 3 at a position upstream of the point Y in the direction of rotation of the developing sleeve 4. As a result, the developer 3 conveyed to the point Y and the developer 3 being conveyed along the interface X are brought out of balance with respect to the conveying amount of the developer 3. In this condition, the two parts of the developer 3 collide against each other. As a result, as illustrated in FIG. 2B, the point Y rises, i.e., the thickness of the layer of the developer 3 containing the interface X increases. At the same time, the thickness of the developer 3 passing through the gap between the edge of the first doctor blade 6 and the periphery of the developing sleeve 4 sequentially increases. The increased part of the developer 3 is then scraped off by the second doctor 7 blade at the second doctor blade regulation position G2.

As illustrated in FIG. 2C, when the developer 3 moved away from the first doctor blade 6 reaches a predetermined toner density, the increased part of the developer 3 scraped off by the second doctor blade 7 forms a layer which closes the toner supply opening 20. Consequently, the supply of the toner 3*b* ends. At this time, the volume of the developer 3 in the developer storing section A increases due to the increase in toner density, and thereby the space in the developer storing section A is reduced. This slows down the circulation of the developer 3 moving in the direction b.

The developer 3 scraped off by the second doctor blade 7 and closing the opening 20 moves at a speed of 1 mm/sec. and higher and hits against the surface 10*b* of the projection 10*a*, as indicated by an arrow c in FIG. 2C. The surface 10*b* is inclined by a predetermined angle toward the developing sleeve 4 and has a predetermined length. Therefore, the developer 3 which hits against the surface 10*b* is prevented from dropping into the toner hopper 8. This maintains the amount of the developer 3 constant and allows the supply of the toner 3*b* to be automatically controlled at all times.

In order to obtain a good quality image free from irregular density in the developing device 2 with the above-described configuration, it is preferable that the developer 3 is sufficiently agitated to be adequately charged in the developer storing section A, and then conveyed by the developing sleeve 4 to the developing area where the developing sleeve 4 faces the photoconductive drum 1. Further, in order to sufficiently agitate the developer 3 in the developer storing section A, it is preferable that the conveying force exerted to the developer 3 being conveyed through the gap between the edge of the second doctor blade 7 and the periphery of the developing sleeve 4 toward the developer storing section A is greater than the conveying force exerted on the developer 3 being conveyed from the developer storing section A through the gap between the edge of the first doctor blade 6 and the periphery of the developing sleeve 4. By configuring the conveying force exerted on the developer 3 as described above, the developer 3 conveyed into the developer storing section A is blocked by the first doctor blade 6 due to the difference of the conveying forces for the developer 3 between when the developer 3 passes through the gap between the edge of the first doctor blade 6 and the periphery of the developing sleeve 4 and when the developer 3 passes through the gap between the edge of the second doctor blade 7 and the periphery of the developing sleeve 4. As a result, the developer 3 conveyed by the developing sleeve 4 into the developer storing section A tends to interfere with the developer 3 in the developer storing section A, and thereby the developer 3 is agitated well in the developer storing section A.

Figure 3:
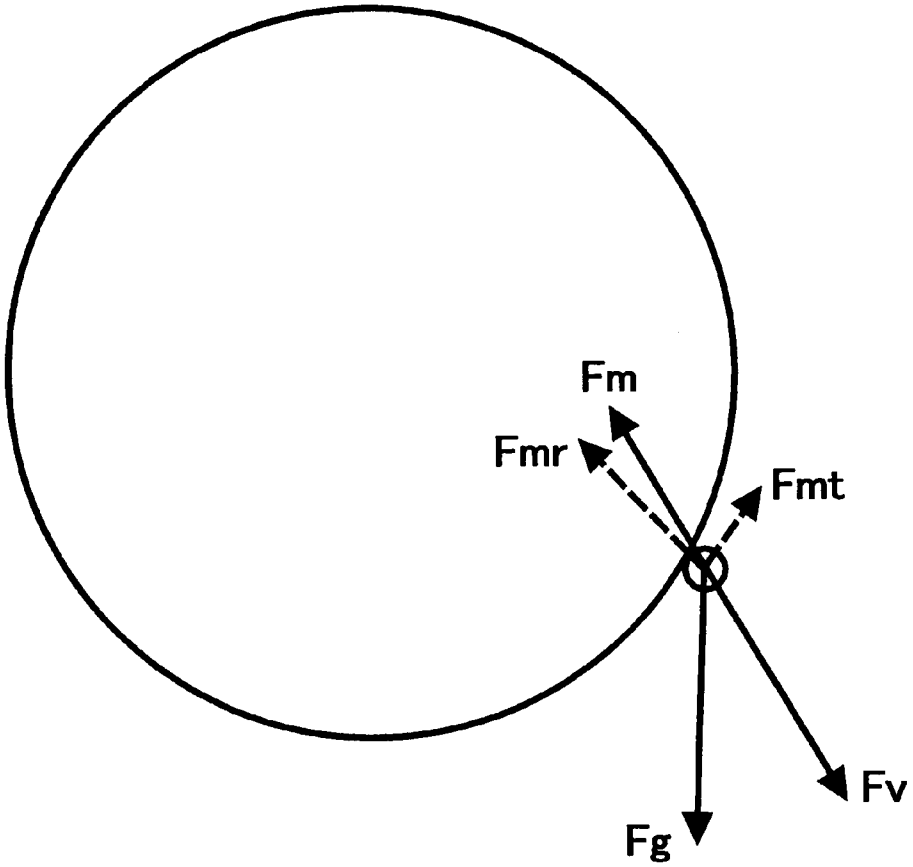
FIG. 3 is an explanatory view of forces exerted on the developer carried by a developer carrier according to the embodiment of the present invention.

Hereinafter, a description will be made as to how the above-described preferable relation between the conveying forces for the developer 3 is obtained. FIG. 3 is an explanatory view illustrating forces exerted on the developer 3 carried by the developing sleeve 4. Referring to FIG. 3, for example, a magnetic force Fm generated by the magnetic roller 5, the force of gravity Fg, and a centrifugal force Fv are exerted on the developer 3 on the developing sleeve 4. Among the above-described three forces, the magnetic force Fm has the most influence on the developer 3 which is on the developing sleeve 4. As illustrated in FIG. 3, the magnetic force Fm is a resultant of a magnetic force Fmr in a radial direction of the developing sleeve 4 and a magnetic force Fmt in a tangential direction of the developing sleeve 4. Japanese Laid-open Patent Publication No. 5-249821, which is incorporated herein by reference, describes that the magnetic force Fm is approximately obtained by measuring a magnetic flux density distribution in the radial direction of the developing sleeve 4 and by algebraic calculation. The same method of obtaining the magnetic force Fm as Japanese Laid-open Patent Publication No. 5-249821 can be also employed in this embodiment.

Assuming that $\mu$ represents a coefficient of friction between the developer 3 and the surface of the developing sleeve 4, Fmr represents a magnetic force in a radial direction of the developing sleeve 4, and Fmt represents a magnetic force in a tangential direction of the developing sleeve 4, a conveying force for the developer 3 carried by the developing sleeve 4 thereon caused by the movement of the surface of the developing sleeve 4 is determined by the following formula;

$$\text{Conveying force for developer} = \mu X\ Fmr + Fmt \quad (1)$$

In this embodiment, the magnetic force Fm generated by the magnetic roller 5 included in the developing sleeve 4 is adjusted such that a relation between each magnetic force exerted on the developer 3 carried by the developing sleeve 4 at the first doctor blade regulating position G1 and at the second doctor blade regulating position G2 satisfies the following condition:

$$\mu X\ Fr1=Ft1<\mu X\ Fr2+Ft2 \quad (2)$$

where $\mu$ is a coefficient of friction between the developer 3 and the surface of the developer sleeve 4, Fr1 is a radial direction component of the magnetic force at the first doctor blade regulating position G1, Ft1 is a tangential direction component of the magnetic force at the first doctor blade regulating position G1, Fr2 is a radial direction component of the magnetic force at the second doctor blade regulating position G2, and Ft2 is a tangential direction component of the magnetic force at the second doctor blade regulating position G2, and where a direction in which the developer 3 is attracted to the developing sleeve 4 is defined as a positive direction in the radial direction component of the magnetic force, and a developer conveying direction is defined as a positive direction in the tangential direction component of the magnetic force.

Further, focusing on a radial direction magnetic force which has a substantial influence on the conveying force of the developer 3 by the magnetic roller 5, the magnetic roller 5 is provided in the developing sleeve 4 such that the radial direction magnetic force by the magnetic roller 5 satisfies the following condition:

$$F'r1<F'r2 \quad (3)$$

where F'r1 is a radial direction magnetic force exerted on the developer 3 by the magnetic roller 5 at the first doctor blade regulating position G1, and F'r2 is a radial direction magnetic force exerted on the developer 3 by the magnetic roller 5 at the second doctor blade regulating position G2. By satisfying the above-described condition (3), a conveying amount of the developer 3 at the second doctor blade regulating position G2 can be greater than a conveying amount of the developer 3 at the first doctor blade regulating position G1.

Moreover, a direction of a magnetic field which is one of the elements acting on the developer 3 carried by the developing sleeve 4 is controlled by the magnetic roller 5 included in the developing sleeve 4. Specifically, the magnetic roller 5 is provided in the developing sleeve 4 such that a relation between each direction of magnetic fields at the first doctor blade regulating position G1 and the second doctor blade regulating position G2 satisfies the following condition:

$$\tan^{-1}|Hr1/Ht1|>\tan^{-1}|Hr2/Ht2| \quad (4)$$

where Hr1 is a magnetic field in the radial direction of the developing sleeve 4 at the first doctor blade regulating position G1, Ht1 is a magnetic field in the tangential direction of the developing sleeve 4 at the first doctor blade regulating position G1, Hr2 is a magnetic field in the radial direction of the developing sleeve 4 at the second doctor blade regulating position G2, and Ht2 is a magnetic field in the tangential direction of the developing sleeve 4 at the second doctor blade regulating position G2.

Concrete examples of the magnetic roller 5 configured to satisfy the above-described conditions according to the embodiment of the present invention are described hereinafter.

In the examples, the developing device 2 employs the developing sleeve 4 with a 16 mm outside diameter and the magnetic roller 5 with four poles and V-shaped grooves about 0.5 mm in depth formed on the circumferential surface thereof. Table 1 provides a result of testing an example 1 of the magnetic roller 5 according to the embodiment of the present invention and comparative examples 1 through 3 to observe the occurrence of irregular image density. In Table 1, F'r1 represents a radial direction component of the magnetic force by the magnetic roller 5 at the first doctor blade regulating position G1, and F'r2 represents a radial direction component of the magnetic force by the magnetic roller 5 at the second doctor blade regulation position G2. The value of magnetic forces are represented in Table 1 as a ratio relative to the value of F'r1 in example 1 with the value of F'r1 in example 1 set as one. The occurrence of irregular image density is examined in example 1 and comparative examples 1 through 3. In Table 1, a circle mark indicates that the irregular image density did not occur and a cross mark indicates that the irregular image density occurred.

TABLE 1

| | A radial direction component of the magnetic force at the first doctor blade regulating position G1 F'r1 | A radial direction component of the magnetic force at the second doctor blade regulating position G2 F'r2 | Ratio of Developer conveying force (F'r1/F'r2) | Occurrence of Irregular image density |
|---|---|---|---|---|
| Example 1 | 1 | 5 | 0.2 | ○ |
| Comparative example 1 | 2.4 | 2 | 1.2 | X |
| Comparative example 2 | 5 | 2 | 2.5 | X |
| Comparative example 3 | 7 | 2 | 3.5 | X |

In the example 1, a developing operation is performed under the condition that the ratio of F'r1 to F'r2 is 1:5 as indicated in Table 1. Under the above-described ratio condition between F'r1 and F'r2, the ratio of a developer conveying force at the first doctor blade regulating position G1 to a developer conveying force at the second doctor blade regulating position G2 (i.e., F'r1/F'r2) was 0.2. As a result, a good quality image without irregular image density was obtained.

In the comparative examples 1 through 3, the developing operation is performed under the condition that F'r2 is set to be smaller than F'r1. Specifically, the ratio of the developer conveying force at the regulation position G1 to the developer conveying force at the regulation position G2 (i.e., F'r1/F'r2) were respectively 1.2, 2.5, 3.5, in the comparative examples 1, 2, and 3, and the irregular image density occurred on the developed image in all of the comparative examples 1, 2, and 3.

Table 2 provides a result of examining the occurrence of irregular image density with the above example 1 of Table 1 while changing each value of an angle between magnetic fields at the first doctor blade regulating position G1 (i.e., represented as "$\tan^{-1}|Hr1/Hr1|$" in Table 2), and of an angle between magnetic fields at the second doctor blade regulating position G2 (i.e., represented as "$\tan^{-1}|Hr2/Ht2|$" in Table 2). The values of magnetic forces set in the example 1 of Table 1 are applied to all of the example 1, and the comparative examples 1 and 2 in Table 2. In Table 2, a circle mark indicates that the irregular image density did not occur, a triangle mark indicates that the irregular image density occasionally occurred, and a cross mark indicates that the irregular image density occurred more frequently relative to the comparative example 1.

TABLE 2

| | $\tan^{-1}\lvert Hr1/Ht1\rvert$ (degrees) | $\tan^{-1}\lvert Hr2/Ht2\rvert$ (degrees) | Difference (degrees) | Occurrence of Irregular Image Density |
|---|---|---|---|---|
| Example 1 | 85 | 2 | 83 | ○ |
| Comparative example 1 | 75 | 15 | 60 | Δ |
| Comparative example 2 | 47 | 60 | −13 | X |

In the example 1 and comparative example 1, the angle "$\tan^{-1}|Hr1/Ht1|$" between magnetic fields at the first doctor blade regulating position G1 and the angle "$\tan^{1}|Hr2/Ht2|$" between magnetic fields at the second doctor blade regulating position G2 are set to satisfy the above-described condition (4):

$$\tan^{-1}|Hr1/Ht1|>\tan^{-1}|Hr2/Ht2| \quad (4)$$

In the comparative example 2, each of angles "$\tan^{-1}|Hr1/Ht1|$" and "$\tan^{-1}|Hr2/Ht2|$" is set not to satisfy the condition (4).

In the example 1, when a developing operation is performed under the condition that the angle "$\tan^{-1}|Hr1/Ht1|$" is set to 85 degrees and the angle "$\tan^{-1}|Hr2/Ht2|$" is set to 2 degrees, a good quality image without irregular image density is obtained.

In the comparative example 1, when the developing operation is performed under the condition that the angle "$\tan^{-1}|Hr1/Ht1|$" is set to 75 degrees and the angle "$\tan^{-1}|Hr2/Ht2|$" is set to 15 degrees (i.e., narrowing the difference between the above two angles), the irregular image density occasionally occurred on the developed image.

Further, in the comparative example 2, when the angle "$\tan^{-1}|Hr1/Ht1|$" is set to 47 degrees and the angle "$\tan^{-1}|Hr2/Ht2|$" is set to 60 degrees, the irregular image density occurred on the developed image more frequently relative to the comparative example 1.

From the result in Table 1, it has been found that the following effect can be obtained when the conveying force exerted on the developer 3 carried by the developing sleeve 4 at the second doctor blade regulating position G2 is set to be greater than the conveying force exerted on the developer 3 carried by the developing sleeve 4 at the first doctor blade regulating position G1. That is, the developer 3 on the developing sleeve 4 is conveyed into the developer storing section A by the conveying force exerted on the developer 3 at the second doctor blade regulating position G2, while carrying the toner 3*b* supplied thereto from the toner hopper 8. On the other hand, the developer 3 conveyed into the developer storing section A is blocked at the first doctor blade 6 due to a smaller conveying force exerted on the developer 3 at the first doctor blade 6, which is smaller than the conveying force exerted on the developer 3 at the second doctor blade 7. As a result, the developer 3 in the developer storing section A is actively circulated, and thereby the carrier particles 3*a* and toner 3*b* are agitated well. Accordingly, the developer 3 in the developer storing section A can be uniformly charged, and thereby a good quality image free from the irregular image density can be obtained.

Further, from the result in Table 2, it has been found that even when the relation of the developer conveying forces for the developer 3 at the first doctor blade regulating position G1 and the second doctor blade regulating position G2 satisfies the above-described condition, the quality of an image changes depending on the angle between magnetic fields at the first doctor blade regulating position G1 (i.e., the angle "$\tan^{-1}|Hr1/Ht1|$") and the angle between magnetic fields at the second doctor blade regulating position G2 (i.e., the angle "$\tan^{-1}|Hr2/Ht2|$").

Specifically, when the angle between magnetic fields at the first doctor blade regulating position G1 (i.e., the angle "$\tan^{-1}|Hr1/Ht1|$") is smaller than the angle between magnetic fields at the second doctor blade regulating position G2 (i.e., the angle "$\tan^{-1}|Hr2/Ht2|$"), i.e., $\tan^{-1}|Hr1/Ht1|>\tan^{-1}|Hr2/Ht2|$, a conveying amount of the developer 3 at the second doctor blade regulating position G2 becomes greater than a conveying amount of the developer 3 at the first doctor blade regulating position G1. In detail, it is known that the developer 3 is carried on the developing sleeve 4 with carrier particles carrying toner linked each other in several chains and that these chains of the developer 3 are directed to a direction of magnetic field generated by the magnetic roller 5 and thereby a so-called developer ear is formed on the developing sleeve 4. However, when an angle between magnetic fields in a radial direction of the developing sleeve 4 and in a tangential direction of the developing sleeve 4 is small, the developer ear is not formed on the developing sleeve 4, so that the developer 3 is in a dense condition on the surface of the developing sleeve 4. When the developer 3 in such a dense condition is regulated by a predetermined gap formed by the first doctor blade 6 or the second doctor blade 7, the amount of the developer 3 being conveyed downstream of the first doctor blade 6 or the second doctor blade 7 in the developer conveying direction becomes greater than the amount of developer 3 when the developer 3 with a developer ear formed is regulated by the predetermined gap formed by the first doctor blade 6 or the second doctor blade 7. That is, as the direction of the magnetic field is closer to the tangential direction of the developing sleeve 4, the conveying amount of the developer 3 becomes greater. In other words, as the angle between magnetic fields in a radial direction of the developing sleeve 4 and in a tangential direction of the developing sleeve 4 is smaller, the conveying amount of the developer 3 becomes greater.

When the conveying amount of the developer 3 at the second doctor blade regulating position G2 is greater than the conveying amount of the developer 3 at the first doctor blade regulating position G1, the developer 3 in the developer storing section A is actively circulated because the developer 3 conveyed into the developer storing section A is blocked by the first doctor blade 6 due to the difference of the conveying amount of the developer 3 between when the developer 3 passes through the gap between the edge of the first doctor blade 6 and the periphery of the developing sleeve 4 and when the developer 3 passes through the gap between the edge of the second doctor blade 7 and the periphery of the developing sleeve 4, and thereby the carrier particles 3*a* and toner 3*b* are agitated well. Accordingly, the developer 3 in the developer storing section A can be uniformly and sufficiently charged by making the angle between magnetic fields at the first doctor blade regulating position G1 (i.e., the angle "$\tan^{-1}|Hr1/Ht1|$") smaller than the angle between magnetic fields at the second doctor blade regulating position G2 (i.e., the angle "$\tan^{-1}|Hr2/Ht2|$"), and thereby a good quality image free from the irregular image density can be obtained.

Moreover from the result in Table 2, the relation between the angle "$\tan^{-1}|Hr1/Ht1|$" and the angle "$\tan^{-1}|Hr2/Ht2|$" set in the example 1 is preferable to the one in the comparative example 1, because the irregular image density did not occur in the example 1 but occasionally occurred on the developed image in the comparative example 1.

Hereinafter, the second embodiment of the present invention is described. The detailed description will be omitted for the elements which are the same as with FIG. 1 for the sake of simplification of the description. The developing device 2 in the second embodiment has the same configuration as the one of FIG. 1.

Figure 4A:
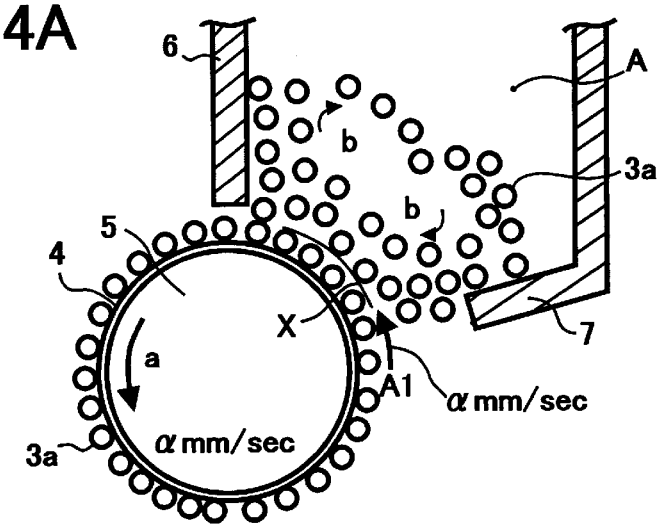
FIGS. 4A through 4C are explanatory views of a behavior of a developer in a developing device according to a second embodiment of the present invention.
Figure 4B:
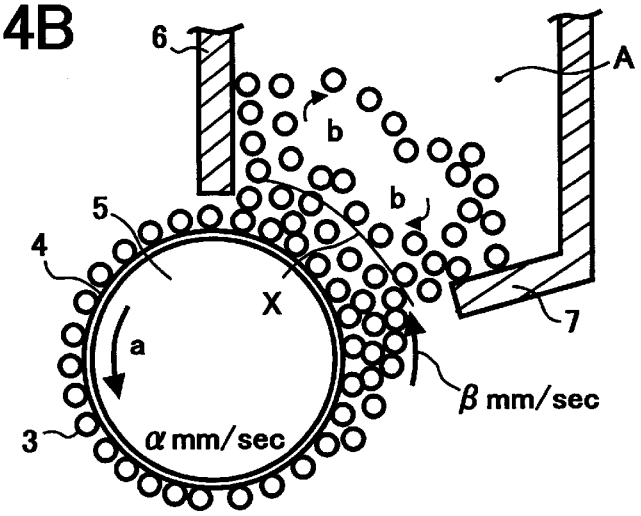
Figure 4C:
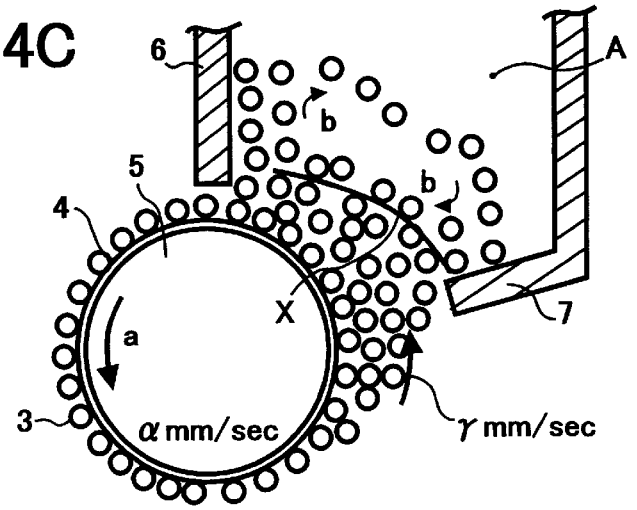

Referring to FIGS. 4A through 4C, description will be made with respect to the behavior of the developer 3 and a mechanism of toner density control when the toner image is formed. As illustrated in FIG. 4A, when a starting agent consisting of only magnetic carrier particles 3*a* is set in the developing device 2, the carrier particles 3*a* are partly magnetically deposited on the developing sleeve 4 and partly received in the developer storing section A. The carrier particles 3*a* received in the developer storing section A are circulated in the direction indicated by an arrow b by the magnetic force acting from the magnetic roller 5 and by the rotation of the developing sleeve 4 in the direction indicated by an arrow a. An interface X is formed between the surface of the carrier particles 3*a* carried and conveyed by the developing sleeve 4 and the surface of the carrier particles 3*a* moving in the developer storing section A.

Subsequently, when the toner 3*b* is set in the toner hopper 8, the toner 3*b* is supplied to the carrier particles 3*a* carried and conveyed by the developing sleeve 4 via the toner supply opening 20. As a result, the developing sleeve 4 carries the developer 3 that is the mixture of the carrier particles 3*a* and toner 3*b*. While the toner density of the developer 3 is low, the toner 3*b* is supplied to the developer 3 at a position of A1 illustrated in FIG. 4A near the surface of the developing sleeve 4. At the position of A1, a moving speed mm/sec. of the developer 3 is relatively high, and the amount of supply of the toner 3*b* is relatively large.

The developer 3 in the developer storing section A exerts a force tending to stop the developer 3 being conveyed by the developing sleeve 4. When the toner 3*b* existing on the surface of the developer 3 carried by the developing sleeve 4 is brought to the interface X, friction acting between the two parts of the developer 3 around the interface X decreases, and in turn the developer conveying force around the interface X decreases. As a result, the amount of the developer 3 being conveyed decreases around the interface X. At a position upstream side of the developing sleeve 4 in the rotating direction of the developing sleeve 4 in the developer storing section A, the above-described force tending to stop the developer 3 being carried and conveyed by the developing sleeve 4 does not act on the developer 3. As a result, the developer 3 conveyed to the position upstream side of the developing sleeve 4 in the rotating direction of the developing sleeve 4 in the developer storing section A and the developer 3 being conveyed along the interface X are brought out of balance with respect to the conveying amount of the developer 3. In this condition, the two parts of the developer 3 collide against each other. As a result, as illustrated in FIG. 4B, the thickness of the layer of the developer 3 containing the interface X increases. Further, a moving speed mm/sec. of the developer 3 in FIG. 4B is lower than the moving speed mm/sec. of the developer 3 in FIG. 4A. Furthermore, the thickness of the developer 3 passing through the gap between the edge of the first doctor blade 6 and the periphery of the developing sleeve 4 sequentially increases. The increased part of the developer 3 is then scraped off by the second doctor blade 7.

As illustrated in FIG. 4C, when the developer 3 moved away from the first doctor blade 6 reaches a predetermined toner density, the increased part of the developer 3 scraped off by the second doctor blade 7 and forming a layer closes the toner supply opening 20. A moving speed of mm/sec. of the developer 3 in FIG. 4C becomes lower than the moving speed of mm/sec. of the developer 3 in FIG. 4B, i.e., down to about 0 mm/sec. Consequently, the supply of the toner 3*b* ends. At this time, the volume of the developer 3 in the developer storing section A increases due to the increase in toner density, and thereby the space in the developer storing section A is reduced. This slows down the circulation of the developer 3. At a position apart from the developing sleeve 4 in the developer storing section A, the developer 3 keeps circulating at a speed of about 10 mm/sec.

In the above-described developing device 2, a supply of the toner 3*b* to the developer 3 carried by the developing sleeve 4 depends on, for example, the amount of the developer 3 on the developing sleeve 4 in a vicinity of the toner supply opening 20, and thereby the toner covering ratio of the developer 3 in the developer storing section A changes. A toner covering ratio Th is given by the following formula:

$$Th = \frac{100\sqrt{3C}}{2\pi(100 - C)\cdot(1 + r/R)^2\cdot(r/R)\cdot(\rho t/\rho c)}$$

where C is a toner density of the developer (wt %), r is a radius of toner particles ($\mu$m), R is a radius of carrier particles ($\mu$m), pt is a true specific gravity of the toner particles (g/cm3), and ρc is a true specific gravity of the carrier particles (g/cm3). Various formulas of calculation of the toner covering ratio have been proposed, and the formula for the calculation of the toner covering ratio in this embodiment of the present invention is not limited to the above-described formula.

The toner covering ratio of the developer 3 is preferably in a range of about 80% to about 100%. When the developer 3 has a toner covering ratio excessively lower than about 80% and if a large size image is successively developed with the developer 3, a relatively large amount of toner is used for the development in a relatively short time, and the supply of the toner 3*b* to the developer 3 cannot be sufficiently made, and thereby the toner density of the developer 3 is decreased. As a result, the image density of the developed image becomes too low and in addition adhesion of carrier particles 3*a* to the image occurs. On the other hand, if an image is developed with the developer 3 of a higher toner covering ratio, it is likely that background fouling and a fog of an image occur. Therefore, it is preferable that the supply of toner to the developer 3 is precisely controlled such that while the toner covering ratio of the developer 3 is lower than about 80%, the toner 3*b* is positively supplied to the developer 3, and while the toner covering ratio of the developer 3 is in a range of about 80% to about 100%, the supply of the toner 3*b* to the developer 3 is stopped.

Figure 5:
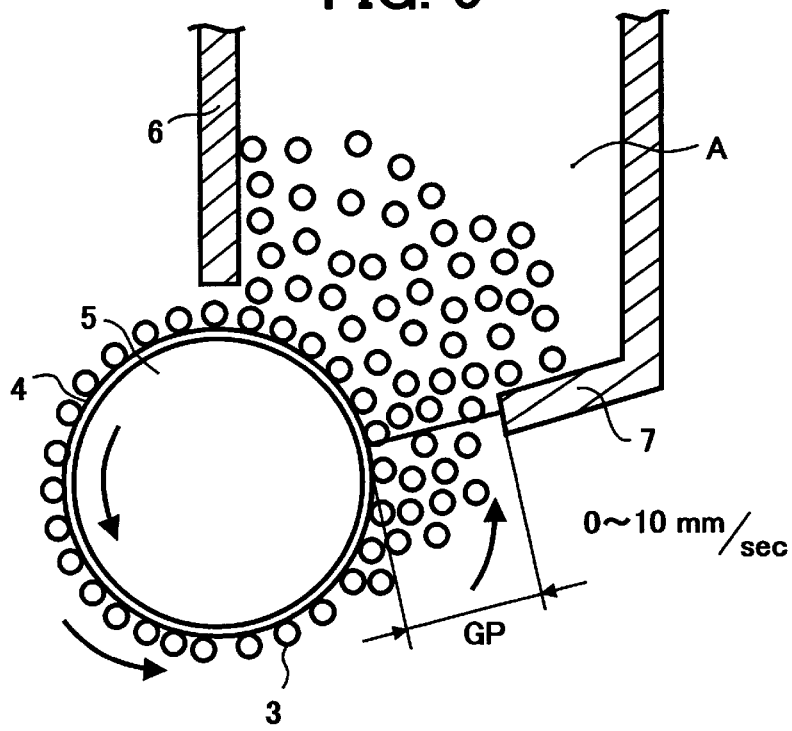
FIG. 5 is a partial enlarged view of the developing device according to an embodiment of the present invention.

FIG. 5 is a partial enlarged view of the developing device 2 according to an embodiment of the present invention. The developing device 2 has a configuration that can control the toner covering ratio within a range suitable for development. In the developing device 2 illustrated in FIG. 5, a gap GP between the edge of the second doctor blade 7 and a periphery of the developing sleeve 4 is set such that when the toner covering ratio of the carrier particle 3*a* in the developer 3 stored in the developer storing section A is in a range of about 80% to about 100%, the second doctor blade 7 regulates the developer 3 carried and conveyed by the developing sleeve 4 at a position where the developer 3 carried and conveyed by the developing device 4 moves at a speed of about 0 mm/sec. to about 10 mm/sec. In this embodiment, the gap GP is preferably in the range of 0.5 mm to 2.0 mm, although other ranges may be used, if desired. The reasons for setting the gap in the preferred range of 0.5 mm to 2.0 mm are set forth in detail below with respect to the description of FIG. 7.

It has been found that if the edge of the second doctor blade 7 is set in a position where the moving speed of the developer 3 carried and conveyed by the developing sleeve 4 is faster than 10 mm/sec., yet the toner covering ratio is in the proper range of 80% to 100%, the toner 3*b* is oversupplied to the developer 3. On the contrary, if the edge of the second doctor blade 7 is set in a position where the moving speed of the developer 3 is 0 mm/sec., the toner 3*b* is not supplied to the developer 3, even if the toner covering ratio is less than 80%, thus causing an undersupply of the toner 3*b*. According to the preferred embodiment, when the toner covering ratio drops below 80%, the moving speed of the developer 3 increases to above about 10 mm/sec. in order to properly supply additional toner 3*b*. Such a supplying of toner decreases or ceases by the moving speed of the developer 3 slowing below 10 mm/sec., when the toner covering ratio reaches the range of around 80% to 100%. That is, when the second doctor blade 7 regulates the developer 3 at a position where the developer 3 carried and conveyed by the developing sleeve 4 such that the developer 3 moves at a speed of about 10 mm/sec. or less, the toner 3*b* is not supplied to the developer 3. Accordingly, when the gap GP is set to the appropriate width, as described above for example, the toner 3*b* can be adequately controlled not to be supplied to the developer 3 when the toner covering ratio of the developer 3 is in a range of about 80% to about 100%. As a result, the toner density of the developer 3 is precisely controlled, and thereby a good quality image can be formed.

Figure 6:
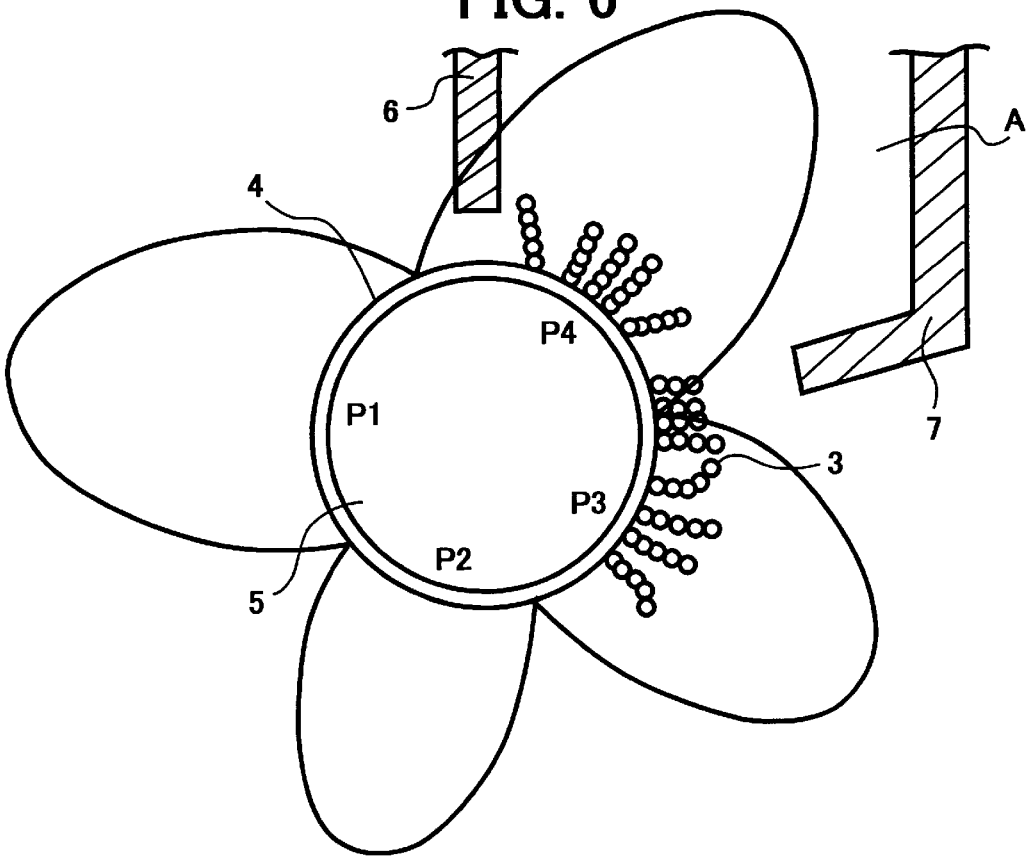
FIG. 6 is a partial enlarged view illustrating a developing device according to another embodiment of the present invention.

FIG. 6 is a partial enlarged view illustrating a developing device according to another embodiment of the present invention. The developing device has the same configuration as the developing device illustrated in FIG. 5. Further, the second doctor blade 7 is arranged such that the second doctor blade 7 regulates the developer 3 carried and conveyed by the developing sleeve 4 at a position in a circumference of the developing sleeve 4 where a magnetic flux density in a direction normal to the surface of the developing sleeve 4 between poles P3 and P4 of the magnetic roller 5 is about 5 mT or less. At the position where the magnetic flux density in a direction normal to the surface of the developing sleeve 4 is about 5 mT or less, an ear of the developer 3 carried on the developing sleeve 4 is laid on the surface of the developing sleeve 4. By setting the edge of the second doctor blade 7 at the above-described position, it can prevent the toner 3*b* supplied to the developer 3 from directly adhering to the surface of the developing sleeve 4, so that the toner 3*b* can be surely supplied to the surface of the developer 3. If the toner 3*b* having an ear directly adheres to the surface of the developing sleeve 4, background fouling likely occurs on an image because it is difficult to remove the adhered toner from the surface of the developing sleeve 4 in the following process and the adhered toner is conveyed to the developing area. After the toner 3*b* is supplied to the developer 3, the first doctor blade 6 regulates the thickness of the developer 3. Therefore, the amount of toner 3*b* supplied to the developing area can be precisely controlled. According to the above-described embodiment of the present invention, the toner 3*b* is precisely supplied to the developer 3 on the developing sleeve 4, so that a good quality image free from irregular image density can be formed.

Figure 7:
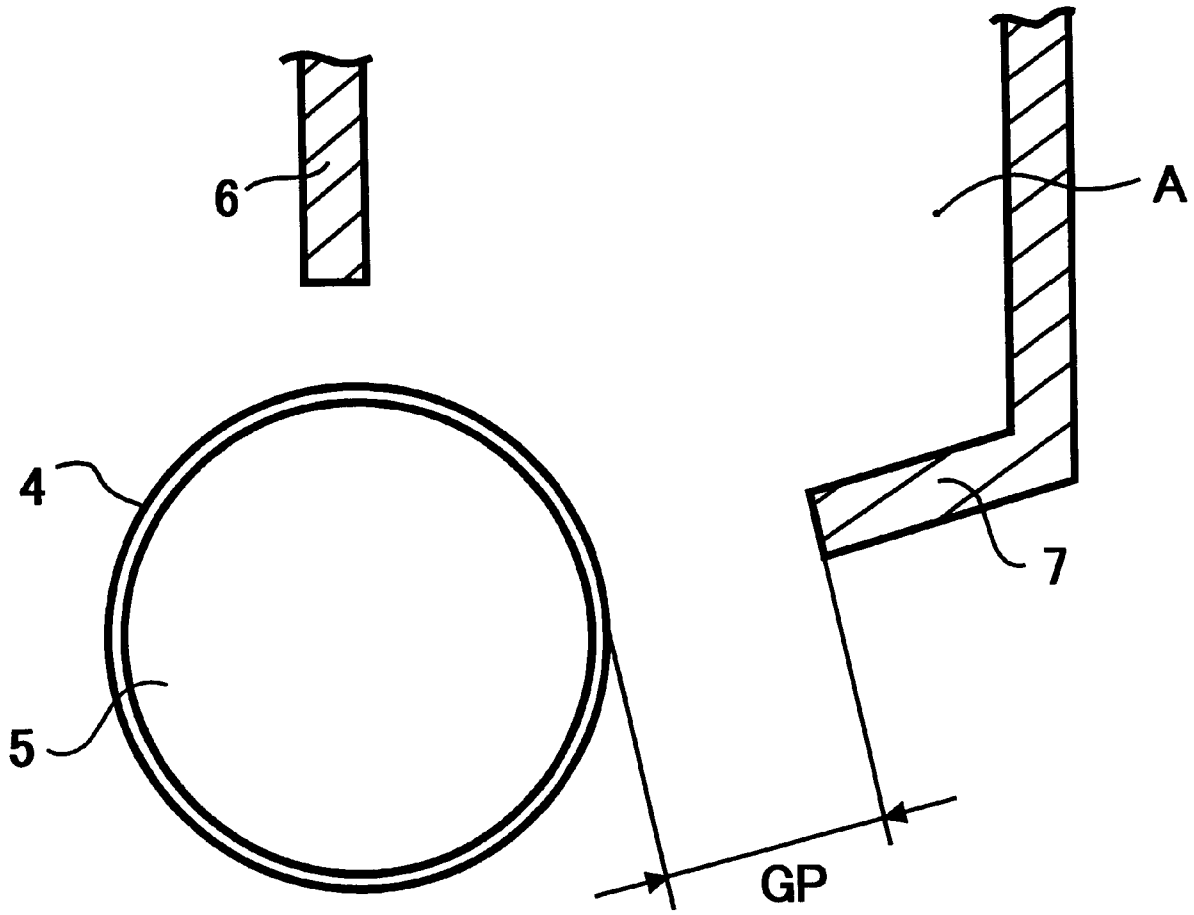
FIG. 7 is a partial enlarged view illustrating a developing device according to another embodiment of the present invention.

FIG. 7 is a partial enlarged view illustrating a developing device according to another embodiment of the present invention. The developing device has the same configuration as the developing device illustrated in FIG. 5. Further, the gap GP between the edge of the second doctor blade 7 and the surface of the developing sleeve 4 is set to in a range of about 0.5 mm to about 2.0 mm. By setting the gap GP to 0.5 mm or greater, the gap GP is prevented from being clogged by agglomeration of the carrier particle 3*a* and toner 3*b*, and the toner 3*b* can be uniformly retained over the entire range of the developing sleeve 4 in the axial direction thereof. Moreover, by setting the gap GP to 2.0 mm or less, when the toner covering ratio of the carrier particle 3*a* in the developer storing section A is in a range of about 80% to about 100%, the moving speed of the developer 3 carried and conveyed by the developing sleeve 4 is stabilized in a range of about 0 mm/sec. to about 10 mm/sec. at the second doctor blade 7 and the second doctor blade 7 regulates the toner 3*b* so as not to be supplied to the developer 3 stored in the developer storing section A.

According to the above-described another embodiment, the toner 3*b* is precisely controlled to be supplied to the developer 3 over the entire range of the developing sleeve 4 in the axial direction thereof. Therefore, a good quality image without irregular image density can be formed.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 11-030404 filed in the Japanese Patent Office on Feb. 8, 1999, and on Japanese Patent Application No. 11-031705 filed in the Japanese Patent Office on Feb. 9, 1999, and the entire contents of which are hereby incorporated by reference.

What is claimed as new and is desired to be secured by Letters Patent of the United States is:

1. A developing device comprising:

a developer carrier including a magnetic field generating device therein, configured to carry and convey a developer containing toner and magnetic carrier particles;

a first regulating member configured to regulate the developer being carried and conveyed by the developer carrier;

a developer storing section configured to store developer scraped off the developer carrier by the first regulating member, the developer storing section including a second regulating member for regulating the developer being carried and conveyed by the developer carrier arranged upstream of the first regulating member with respect to a direction in which the developer carrier conveys the developer; and a toner storing section provided adjacent to the developer storing section to supply toner to the developer carrier, wherein, a contact condition of the developer carried on the developer carrier with the toner supplied to the developer carrier from the toner storing section is varied in accordance with variation of a toner density in the developer carried on the developer carrier to thereby vary a condition of the developer on the developer carrier to attract the toner, the second regulating member is spaced from the developer carrier such that when a thickness of a layer of the developer on the developer carrier increases due to an increase of the toner density in the developer on the developer carrier, the second regulating member regulates an increased amount of the developer being carried and conveyed by the developer carrier, and a magnetic force exerted on the developer on the developer carrier satisfies a following condition:

$$\mu X\ Fr1+Ft1<\mu X\ Fr2+Ft2 \quad (1)$$

where $\mu$ is a coefficient of friction between the developer and a surface of the developer carrier, Fr1 is a radial direction component of the magnetic force at a position of the developer carrier facing the first regulating member, Ft1 is a tangential direction component of the magnetic force at the position of the developer carrier facing the first regulating member, Fr2 is a radial direction component of the magnetic force at a position of the developer carrier facing the second regulating member, and Ft2 is a tangential direction component of the magnetic force at the position of the developer carrier facing the second regulating member, and where a direction in which the developer is attracted to the developer carrier is defined as a positive direction in the radial direction component of the magnetic force, and a developer conveying direction is defined as a positive direction in the tangential direction component of the magnetic force.

2. The developing device according to claim 1, wherein an angle between magnetic fields acting on the developer on the developer carrier in a radial direction of the developer carrier and in a tangential direction of the developer carrier satisfies a following condition:

$$\tan^{-1}|Hr1/Ht1|>\tan^{-1}|Hr2/Ht2| \quad (2)$$

where Hr1 is a magnetic field in the radial direction of the developer carrier at the position of the developer carrier facing the first regulating member, Ht1 is a magnetic field in the tangential direction of the developer carrier at the position of the developer carrier facing the first regulating member, Hr2 is a magnetic field in the radial direction of the developer carrier at the position of the developer carrier facing the second regulating member, and Ht2 is a magnetic field in the tangential direction of the developer carrier at the position of the developer carrier facing the second regulating member.

3. The developing device according to claim 1, wherein a radial direction magnetic force exerted on the developer by the magnetic field generating device of the developer carrier satisfies a following condition:

$$F'r1<F'r2 \quad (3)$$

where F'r1 is a radial direction magnetic force exerted on the developer by the magnetic field generating device at a position of the developer carrier facing the first regulating member, and F'r2 is a radial direction magnetic force exerted on the developer by the magnetic field generating device at a position of the developer carrier facing the second regulating member.

4. The developing device according to claim 2, wherein the condition (2) is satisfied by a magnetic force of the magnetic field generating device of the developer carrier.

5. A developing device comprising:

a developer carrier including a magnetic field generating device therein, configured to carry and convey a developer containing toner and magnetic carrier particles;

a first regulating member configured to regulate the developer being carried and conveyed by the developer carrier;

a developer storing section configured to store developer scraped off the developer carrier by the first regulating member, the developer storing section including a second regulating member for regulating the developer being carried and conveyed by the developer carrier arranged upstream of the first regulating member with respect to a direction in which the developer carrier conveys the developer; and a toner storing section to store toner, which is provided adjacent to the developer storing section and has a toner supply opening to supply the toner to the developer carrier, wherein a contact condition of the developer carried on the developer carrier with the toner supplied to the developer carrier from the toner storing section is varied in accordance with variation of a toner density in the developer carried on the developer carrier to thereby vary a condition of the developer on the developer carrier to attract the toner, and the second regulating member facing the surface of the developer carrier is spaced a predetermined distance apart from the surface of the developer carrier such that when a toner covering ratio of a carrier particle in the developer stored in the developer storing section is in a range of about 80% to about 100%, the second regulating member regulates the toner supplied onto the developer carrier so as not to be supplied to the developer in the developer storing section.

6. The developing device according to claim 5, wherein the second regulating member is spaced the predetermined distance apart from the surface of the developer carrier such that when a toner covering ratio of a carrier particle in the developer stored in the developer storing section is in a range of about 80% to about 100%, the second regulating member regulates the developer being carried and conveyed by the developer carrier at a position where the developer moves at a speed of about 0 mm/sec. to about 10 mm/sec.

7. The developing device according to claim 5, wherein the second regulating member regulates the developer being carried and conveyed by the developer carrier at a position in a developer conveying direction where a magnetic flux density in a direction normal to the surface of the developer carrier is about 5 mT or less.

8. The developing device according to claim 5, wherein the second regulating member is spaced about 0.5 mm to about 2.0 mm apart from the surface of the developer carrier.

9. A developing device comprising:

a developer carrier including a magnetic field generating device therein, configured to carry and convey a developer containing toner and magnetic carrier particles;

a first regulating member configured to regulate the developer being carried and conveyed by the developer carrier;

a developer storing section configured to store developer scraped off the developer carrier by the first regulating member, the developer storing section including a second regulating member for regulating the developer being carried and conveyed by the developer carrier arranged upstream of the first regulating member with respect to a direction in which the developer carrier conveys the developer; and a toner storing section provided adjacent to the developer storing section to supply toner to the developer carrier, wherein, a contact condition of the developer carried on the developer carrier with the toner supplied to the developer carrier from the toner storing section is varied in accordance with variation of a toner density in the developer carried on the developer carrier to thereby vary a condition of the developer on the developer carrier to attract the toner, the second regulating member is spaced from the developer carrier such that when a thickness of a layer of the developer on the developer carrier increases due to an increase of the toner density in the developer on the developer carrier, the second regulating member regulates an increased amount of the developer being carried and conveyed by the developer carrier, and an angle between magnetic fields acting on the developer on the developer carrier in a radial direction of the developer carrier and in a tangential direction of the developer carrier satisfies a following condition:

$$\tan^{-1}|Hr1/Ht1|>\tan^{-1}|Hr2/Ht2|$$

where Hr1 is a magnetic field in the radial direction of the developer carrier at the position of the developer carrier facing the first regulating member, Ht1 is a magnetic field in the tangential direction of the developer carrier at the position of the developer carrier facing the first regulating member, Hr2 is a magnetic field in the radial direction of the developer carrier at the position of the developer carrier facing the second regulating member, and Ht2 is a magnetic field in the tangential direction of the developer carrier at the position of the developer carrier facing the second regulating member.

10. A method of transporting a developer, comprising the steps of:

rotating a developer transport drum having a magnetic field generating device therein;

regulating, while rotating the developer transport drum, an amount of developer which includes toner and magnetic carrier particles which are on the developer transport drum using a first regulating member, and storing excess developer which has been regulated in a developer section which is open towards the developer transport drum;

regulating, while rotating the developer transport drum, an amount of toner which is supplied to the developer transport drum by a second regulating member which is different from the first regulating member such that less toner is supplied to the developer transport drum when a toner density in the developer increases; and generating a magnetic force on the developer by the magnetic field generating device such that:

$$\mu X\ Fr1+Ft1<\mu X\ Fr2+Ft2$$

where $\mu$ is a coefficient of friction between the developer and a surface of the developer transport drum, Fr1 is a radial direction component of the magnetic force at a position of the developer transport drum facing the first regulating member, Ft1 is a tangential direction component of the magnetic force at the position of the developer transport drum facing the first regulating member, Fr2 is a radial direction component of the magnetic force at a position of the developer transport drum facing the second regulating member, and Ft2 is a tangential direction component of the magnetic force at the position of the developer transport drum facing the second regulating member, and where a direction in which the developer is attracted to the developer transport drum is defined as a positive direction in a radial direction component of the magnetic force, and a developer conveying direction is defined as a positive direction in the tangential direction component of the magnetic force.

11. A method according to claim 10, wherein the step of generating the magnetic force comprises:

generating the magnetic force such that an angle between magnetic fields acting on the developer on the developer transport drum in a radial direction of the developer transport drum and in a tangential direction of the developer transport drum satisfies a following condition:

$$\tan^{-1}|Hr1/Ht1|>\tan^{-1}|H2/Ht2|$$

where Hr1 is a magnetic field in the radial direction of the developer transport drum at the position of the developer transport drum facing the first regulating member, Ht1 is a magnetic field in the tangential direction of the developer transport drum at the position of the developer transport drum facing the first regulating member, Hr2 is a magnetic field in the radial direction of the developer transport drum at the position of the developer transport drum facing the second regulating member, and Ht2 is a magnetic field in the tangential direction of the developer transport drum at the position of the developer transport drum facing the second regulating member.

12. A method according to claim 10, wherein the step of generating the magnet force comprises:

generating the magnetic force such that a radial direction magnetic force exerted on the developer by the magnetic field generating device of the developer transport drum satisfies a following condition:

$$F'r1<F'r2$$

where F'r1 is a radial direction magnetic force exerted on the developer by the magnetic field generating device at a position of the developer transport drum facing the first regulating member, and F'r2 is a radial direction magnetic force exerted on the developer by the magnetic field generating device at a position of the developer transport drum facing the second regulating member.

13. A method of transporting a developer, comprising the steps of:

rotating a developer transport drum having a magnetic field generating device therein;

regulating, while rotating the developer transport drum, an amount of developer which includes toner and magnetic carrier particles which are on the developer transport drum using a first regulating member, and storing excess developer which has been regulated in a developer section which is open towards the developer transport drum;

regulating, while rotating the developer transport drum, an amount of toner which is supplied to the developer transport drum by a second regulating member which is different from the first regulating member such that less toner is supplied to the developer transport drum when a toner density in the developer increases and toner is not supplied to the developer transport drum when a toner density of the developer is 80% to 100%.

14. A method according to claim 13, wherein the step of regulating the toner by the second regulating member comprises:

supplying toner when a speed of the developer near the developer transport drum exceeds 10 mm/sec.

15. A method according to claim 14, wherein the step of regulating the toner by the second regulating member comprises:

preventing a supply of toner when a speed of the developer near the developer transport drum is between 0 mm/sec. and 10 mm/sec.

16. A method according to claim 13, wherein the step of regulating the toner by the second regulating member comprises:

preventing a supply of toner when a speed of the developer near the developer transport drum is between 0 mm/sec. and 10 mm/sec.

17. A method according to claim 13, wherein the step of regulating the toner by the second regulating member comprises:

regulating the developer at a position where a magnetic flux density in a direction normal to the surface of the developer transport drum is about 5 mT or less.

18. A method according to claim 13, wherein the step of regulating the toner by the second regulating member comprises:

regulating the developer using the second regulating member which is spaced about 0.5 mm to about 2.0 mm apart from the surface of the developer transport drum.

19. A method of transporting a developer, comprising the steps of:

rotating a developer transport drum having a magnetic field generating device therein;

regulating, while rotating the developer transport drum, an amount of developer which includes toner and magnetic carrier particles which are on the developer transport drum using a first regulating member, and storing excess developer which has been regulated in a developer section which is open towards the developer transport drum;

regulating, while rotating the developer transport drum, an amount of toner which is supplied to the developer transport drum by a second regulating member which is different from the first regulating member such that less toner is supplied to the developer transport drum when a toner density in the developer increases; and generating a magnetic force on the developer by the magnetic field generating device such that an angle between magnetic fields acting on the developer on the developer transport drum in a radial direction of the developer transport drum and in a tangential direction of the developer transport drum satisfies a following condition:

$$\tan^{-1}|Hr1/Ht1|>\tan^{-1}|H2/Ht2|$$

where Hr1 is a magnetic field in the radial direction of the developer transport drum at the position of the developer transport drum facing the first regulating member, Ht1 is a magnetic field in the tangential direction of the developer transport drum at the position of the developer transport drum facing the first regulating member, Hr2 is a magnetic field in the radial direction of the developer transport drum at the position of the developer transport drum facing the second regulating member, and Ht2 is a magnetic field in the tangential direction of the developer transport drum at the position of the developer transport drum facing the second regulating member.

20. A system for transporting a developer, comprising the steps of:

a developer transport means having a means for generating a magnetic field therein;

a first means for regulating, while rotating the developer transport means, an amount of developer which includes toner and magnetic carrier particles which are on the developer transport means, and storing excess developer which has been regulated in a developer section which is open towards the developer transport means; and a second means for regulating, while rotating the developer transport means, an amount of toner which is supplied to the developer transport means such that less toner is supplied to the developer transport means when a toner density in the developer increases, wherein the means for generating the magnetic field generates a magnetic force on the developer such that:

$$\mu X\ Fr1+Ft1<\mu X\ Fr2+Ft2$$

where $\mu$ is a coefficient of friction between the developer and a surface of the developer transport means, Fr1 is a radial direction component of the magnetic force at a position of the developer transport means facing the first means for regulating, Ft1 is a tangential direction component of the magnetic force at the position of the developer transport means facing the first means for regulating, Fr2 is a radial direction component of the magnetic force at a position of the developer transport means facing the second means for regulating, and Ft2 is a tangential direction component of the magnetic force at the position of the developer transport means facing the second means for regulating, and where a direction in which the developer is attracted to the developer transport means is defined as a positive direction in a radial direction component of the magnetic force, and a developer conveying direction is defined as a positive direction in the tangential direction component of the magnetic force.

21. A system according to claim 20, wherein the means for generating the magnetic filed comprises:

means for generating the magnetic force such that an angle between magnetic fields acting on the developer on the developer transport means in a radial direction of the developer transport means and in a tangential direction of the developer transport means satisfies a following condition:

$$\tan^{-1}|Hr1/Ht1|>\tan^{-1}|H2/Ht2|$$

where Hr1 is a magnetic field in the radial direction of the developer transport means at the position of the developer transport means facing the first means for regulating, Ht1 is a magnetic field in the tangential direction of the developer transport means at the position of the developer transport means facing the first means for regulating, Hr2 is a magnetic field in the radial direction of the developer transport means at the position of the developer transport means facing the second means for regulating, and Ht2 is a magnetic field in the tangential direction of the developer transport means at the position of the developer transport means facing the second means for regulating.

22. A system according to claim 20, wherein the means for generating the magnet field comprises:

means for generating the magnetic field such that a radial direction magnetic force exerted on the developer satisfies a following condition:

$$F'r1<F'r2$$

where F'r1 is a radial direction magnetic force exerted on the developer by the means for generating the magnetic field at a position of the developer transport means facing the first means for regulating, and Fr2 is a radial direction magnetic force exerted on the developer by the means for generating the magnetic field at a position of the developer transport means facing the second means for regulating.

23. A system for transporting a developer, comprising:

a developer transport means having a means for generating a magnetic field therein;

a first means for regulating, while rotating the developer transport means, an amount of developer which includes toner and magnetic carrier particles which are on the developer transport means, and storing excess developer which has been regulated in a developer section which is open towards the developer transport means; and a second means for regulating, while rotating the developer transport means, an amount of toner which is supplied to the developer transport means such that less toner is supplied to the developer transport means when a toner density in the developer increases and toner is not supplied to the developer transport means when a toner density of the developer is 80% to 100%.

24. A system according to claim 23, wherein the second means for regulating comprises:

means for supplying toner when a speed of the developer near the developer transport means exceeds 10 mm/sec.

25. A system according to claim 24, wherein the second means for regulating comprises:

means for preventing a supply of toner when a speed of the developer near the developer transport means is between 0 mm/sec. and 10 mm/sec.

26. A system according to claim 23, wherein the second means for regulating comprises:

means for preventing a supply of toner when a speed of the developer near the developer transport means is between 0 mm/sec. and 10 mm/sec.

27. A system according to claim 23, wherein the second means for regulating comprises:

means for regulating the developer at a position where a magnetic flux density in a direction normal to the surface of the developer transport means is about 5 mT or less.

28. A system according to claim 23, wherein the second means for regulating is spaced about 0.5 mm to about 2.0 mm apart from the surface of the developer carrier.

29. A system for transporting a developer, comprising:

a developer transport means having a means for generating a magnetic field therein;

a first means for regulating, while rotating the developer transport means, an amount of developer which includes toner and magnetic carrier particles which are on the developer transport means, and storing excess developer which has been regulated in a developer section which is open towards the developer transport means; and a second means for regulating, while rotating the developer transport means, an amount of toner which is supplied to the developer transport means such that less toner is supplied to the developer transport means when a toner density in the developer increases, wherein the means for generating the magnetic field generates a magnetic force on the developer such that an angle between magnetic fields acting on the developer on the developer transport means in a radial direction of the developer transport means and in a tangential direction of the developer transport means satisfies a following condition:

$$\tan^{-1}|Hr1/Ht1|>\tan^{-1}|H2/Ht2|$$

where Hr1 is a magnetic field in the radial direction of the developer transport means at the position of the developer transport means facing the first means for regulating, Ht1 is a magnetic field in the tangential direction of the developer transport means at the position of the developer transport means facing the first means for regulating, Hr2 is a magnetic field in the radial direction of the developer transport means at the position of the developer transport means facing the second means for regulating, and Ht2 is a magnetic field in the tangential direction of the developer transport means at the position of the developer transport means facing the second means for regulating.

* * * * *